US009593550B1

(12) United States Patent
Jennings

(10) Patent No.: US 9,593,550 B1
(45) Date of Patent: Mar. 14, 2017

(54) SHEAR RAM TYPE BLOWOUT PREVENTER

(71) Applicant: Phyllis A. Jennings, Tomball, TX (US)

(72) Inventor: Charles E. Jennings, Tomball, TX (US)

(73) Assignee: Phyllis A. Jennings, Tomball, TX (US)

( * ) Notice: Subject to any disclaimer, the term of this patent is extended or adjusted under 35 U.S.C. 154(b) by 288 days.

(21) Appl. No.: 14/571,774

(22) Filed: Dec. 16, 2014

Related U.S. Application Data

(60) Provisional application No. 61/964,436, filed on Jan. 6, 2014.

(51) Int. Cl.
*E21B 29/00* (2006.01)
*E21B 33/06* (2006.01)
*E21B 29/08* (2006.01)

(52) U.S. Cl.
CPC ..... *E21B 33/063* (2013.01); *E21B 29/08* (2013.01)

(58) Field of Classification Search
CPC ..... E21B 29/08; E21B 33/06; E21B 33/063
USPC ..... 251/1.3; 166/297, 55, 55.2
See application file for complete search history.

(56) References Cited

U.S. PATENT DOCUMENTS 3,590,920 A * 7/1971 Orund ..... E21B 34/04 166/361
3,716,068 A * 2/1973 Addison ..... E21B 29/08 137/318
3,766,979 A * 10/1973 Petrick ..... E21B 29/08 166/55
4,081,027 A * 3/1978 Nguyen ..... E21B 29/08 116/55
4,523,639 A * 6/1985 Howard, Jr. ..... E21B 29/08 166/323
5,199,493 A * 4/1993 Sodder, Jr. ..... E21B 29/08 166/297
8,387,706 B2 3/2013 Baugh
8,443,880 B1 5/2013 Jahnke
8,449,815 B2 5/2013 Shimizu et al.
8,567,490 B2 * 10/2013 Van Winkle ..... E21B 33/063 166/85.4
8,720,565 B2 * 5/2014 Springett ..... E21B 33/063 166/297

* cited by examiner

*Primary Examiner* — Kenneth L Thompson
(74) *Attorney, Agent, or Firm* — Buskop Law Group, PC; Wendy Buskop

(57) ABSTRACT

An angle-cut shear ram blowout preventer system containing an angle-cut shear ram inside a ram housing with a ram housing bore. A ram cylinder pressure housing can be secured to the ram housing, wherein the ram cylinder pressure housing can be fluidly connected to a hydraulic pressure source or a pneumatic pressure source. A piston in the ram cylinder pressure housing can be fluidly connected to the hydraulic pressure source or the pneumatic pressure source. A taper can be extended from the ram housing bore into a through bore to simultaneously sever a pipe in a well and seal the well once the pipe is severed without requiring additional downhole tools.

20 Claims, 6 Drawing Sheets

SHEAR RAM TYPE BLOWOUT PREVENTER

CROSS REFERENCE TO RELATED APPLICATIONS

The current application claims priority to and the benefit of U.S. Provisional Patent Application Ser. No. 61/964,436 filed on Jan. 6, 2014, entitled "Angle-cut shear-ram type blowout preventer." This reference is incorporated in its entirety.

FIELD

The present embodiments generally relate to an improved blowout preventer and in more particularly a new type blowout preventer (BOP) having one or more angled-cut shear rams so that in the event of a well blowout with pipe in the hole, and the ram piston activated, the angled ram blade with hardened serrations passes across the pipe in the bore, cutting into the pipe at a specific angle with one long power stroke at the same time a second angle lifts up on the pipe causing the pipe to snap and break. This new method is referred to herein as "The Score and Break technique" rather than the old brute force blunt nose crush and mash method customary with conventional BOPs.

BACKGROUND

Having absolute pressure control of a hydrocarbon producing well during all drilling and completion operations is an absolute must. This is to protect personnel first and then the drilling rig and other expensive equipment. The main device in place for well pressure control during these operations is the blowout preventer (BOP). BOP's are designed either as ram, ram-shear or annular BOP'S and all are used to seal a wellbore in the event of a blowout. Drilling for hydrocarbons involves penetrating a variety of subsurface geological formations which are layers in the earth. Each layer comprises a specific geologic composition such as, shale, sandstone, limestone, etc. The layers may contain trapped fluids or gas at different formation pressures, and the formation pressures usually increase with increasing depth. The mud weight of the drilling fluid in the wellbore is made heavy enough with barite etc. to overcome the formation pressure. This is done by increasing the density of the drilling fluid in the wellbore or/and increasing pump pressure at the surface of the well.

There are occasions during drilling operations when a wellbore may penetrate a layer having a formation pressure substantially higher that the pressure maintained in the wellbore by the mud weight. When this occurs, the well is said to have taken what is called a kick. The pressure increase associated with the kick is generally produced by gas along with oil, and water or a combination of all of these, and of course the mud is also kicked back with the influx of formation fluids from within the wellbore. The high pressure kick propagates from a point of entry in the wellbore up-hole from a high pressure region below to a low pressure region above. If the kick is allowed to reach the surface, drilling fluid, well tools, and other drilling tools may be blown out of the wellbore. These blowouts often result in catastrophic destruction of the drilling equipment including the drilling rig and could cause substantial injury or death to rig personnel.

Because of the of the potential for blowouts, BOP's are either installed at the surface or on the sea floor in deep water drilling arrangements so that kicks may be adequately controlled and circulated out of the system. BOP's may be activated to effectively seal in a wellbore until measures can be taken to control the kick and as stated earlier there are several types of BOP's, the most common of which are annular blowout preventers.

Annular blowout preventers typically comprise annular bulk elastomer donut shaped seals that are forced radially inward to squeeze around the drill pipe and/or running tools to completely seal the wellbore. Another type of blowout preventer is the ram-type blowout preventer. Ram-type preventers comprise a body supporting at least two oppositely positioned cylinders on each side of the through bore with powerful pistons internally which actuate rams. The rams may be pipe rams or variable pipe rams which, when activated, move to engage and surround drill pipe and well tools to seal the wellbore. Shear rams which, when activated, move to engage and physically shear any drill pipe or well tools in the wellbore. The rams are located opposite of each other and, whether pipe rams or shear rams the rams normally against one another at the center of the wellbore. In some cases, ram blocks are used which will effectively shear both rigid and flexible materials that are located in the through bore of the BOP.

Prior art of a couple of pipe ram assemblies are disclosed. A common characteristic of these pipe ram and shear ram blowout preventers is that each individual ram assembly comprises a carrier or holder of some type and a ram block connected to the carrier for limited relative lateral movement. One advantage of the former kind of construction is that each ram assembly comprises a relatively movable carrier and ram block, and a seal may be installed between the carrier and ram block, and such seal may be compressively actuated by relative movement of the carrier and ram block. More specifically, the ram assemblies are moved inwardly.

If the blowout preventer is of the pipe ram type, which simply seals around the outer diameter of the drill pipe, it is fairly convenient to design the structure so that the thicknesses of the ram block and carrier, measured longitudinally with respect to the drill pipe, are generally equal. This is desirable because it maximizes the surface area over which the forces may be distributed.

BRIEF DESCRIPTION OF THE DRAWINGS

The detailed description will be better understood in conjunction with the accompanying drawings as follows.

Figure 1:
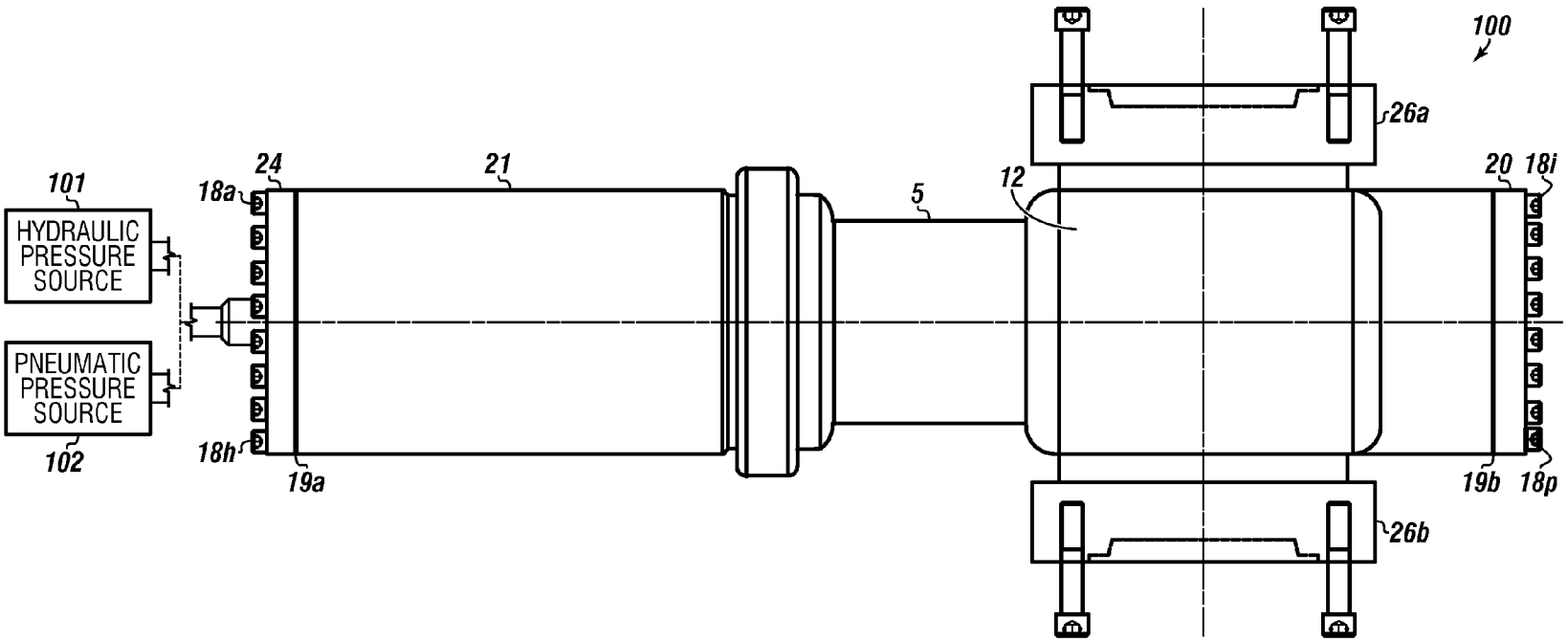
FIG. 1 depicts a side view of the angle-cut shear ram blowout preventer (BOP) system.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments pertain to novel, and new angle-cut shear ram type blowout preventers to be placed and run in the blowout preventer "BOP" stack for the purpose of shearing tubing, pipe, heavy wall drill pipe, heavy drill collars or running tools in the event of a blowout which could occur in many places in the formation of an oil or gas well while the heavy wall drill pipe and/or tools are still in the hole.

This novel BOP comprises a housing having a through vertical bore and can be adapted to be connected to and sealed to a wellhead, a riser or part of a lower marine riser package, placed in alignment with the wellbore. The ram or rams are movable within guide-ways on either side of the ram housing, across the through bore, moving from the fully retracted position where the front cutting edge of the ram can be fully withdrawn and the through bore can be fully open to the fully extended position where the cutting edge has moved across the through bore, cutting anything that might have been in the opening and sealing the through bore.

The angled-cut ram-blade can be made at 40 degrees across the leading cutting edge, to be longer on one side and shorter on the other, resembling a 40 degree triangle with the lead cutting edge tapered at the top away from the heavy wall drill pipe being cut so as to lift the weight of the heavy wall drill pipe while the heavy wall drill pipe is being cut, this is similar to pulling on a piece of steak, stretching it while cutting it with a serrated knife blade. The tapered ram blade can be also serrated with hardened teeth. The ram blade can be thick enough to seal and hold the full well pressure when blocking the through bore.

In this particular disclosure, there is only one angle-cut ram-blade with one powerful piston extending from one side of the BOP housing so when the piston is activated the angle-cut ram moves across the through bore of the BOP, the angled and tapered leading edge of the rams blade forces the opposite side of the heavy wall drill pipe over against the side of the BOP's though bore, pressing against a hardened knife edge to retain the heavy wall drill pipe and help create a stress riser in the heavy wall drill pipe to be cut on the opposite side by the hardened serrated teeth of the ram, The combined forces on both sides of the heavy wall drill pipe plus the rip in the heavy wall drill pipe from the serrated teeth on the shear ram blade as it saws across the heavy wall drill pipe at an angle, along with the upward force caused by the taper on the leading edge of the rams The present embodiments will now be described more fully herein with reference to the illustrated embodiments set forth herein; rather these embodiments are provided so that this disclosure will be thorough and complete and will fully cover the scope of the invention to those skilled in the art. Like numbers refer to like elements through-out. Accompanying drawings in which embodiments of the invention are shown. This invention may, however, be embodied in many different forms and should not be construed as limited to the following.

Turning now to the Figures, FIG. 1 depicts a side view of the angle-cut shear ram blowout preventer (BOP) system.

The angle-cut shear ram blowout preventer (BOP) system 100 can be used over a well when drilling for hydrocarbons through subterranean geological formations, during a blowout in order to simultaneously (i) sever a heavy wall drill pipe in a well and (ii) seal the well once the heavy wall drill pipe is severed without requiring additional downhole tools.

Figure 2:
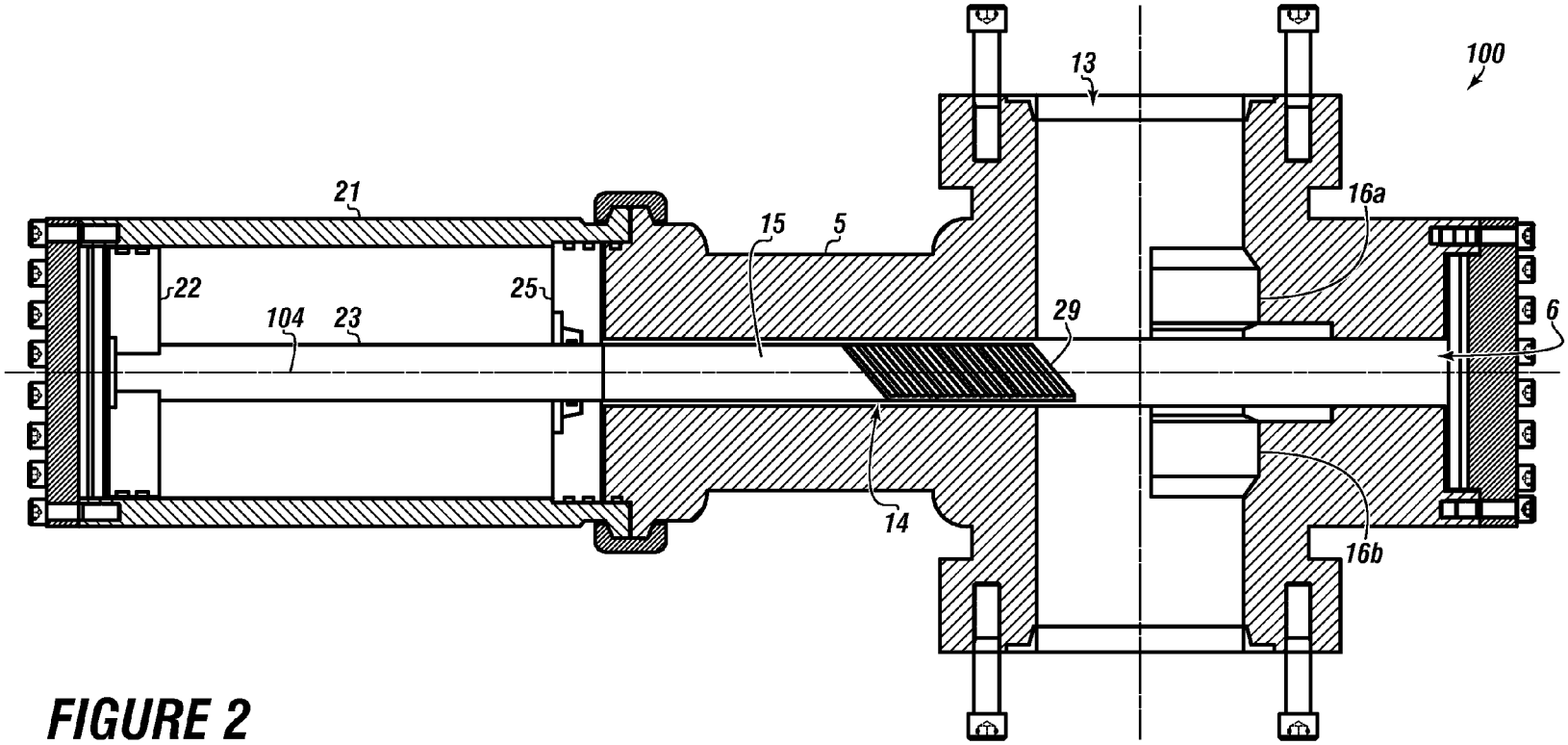
FIG. 2 depicts a cross section of the angle-cut shear ram blowout preventer (BOP) system.
Figure 5:
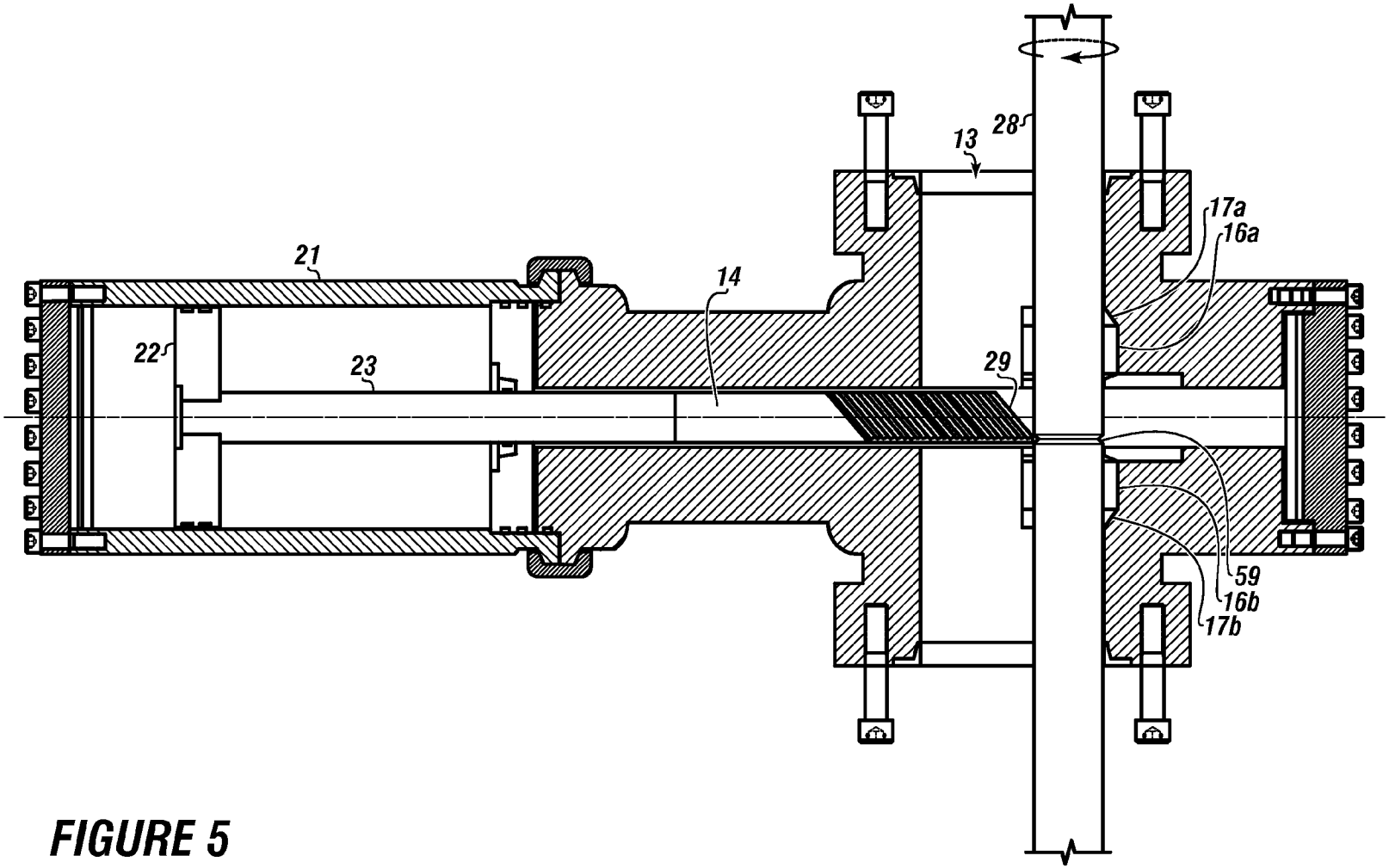
FIG. 5 depicts a cross section of the angle-cut shear ram creating a stress score mark on the heavy wall drill pipe.

The angle-cut shear ram blowout preventer (BOP) system can be installed on a blowout protector housing 12 having a through bore 13, which is shown in FIG. 2. The through bore 13 contains a heavy wall drill pipe 28, which is shown in FIG. 5.

In embodiments, the heavy wall drill pipe 28 extends between a well and a surface. The well flows hydrocarbons or drilling fluids from the well to the surface.

The angle-cut shear ram blowout preventer (BOP) system 100 can be attached to the blowout protector housing 12.

Each angle-cut shear ram blowout preventer (BOP) system 100 can have a ram housing 5 with a ram housing bore 6, which is shown in FIG. 2.

Each angle-cut shear ram blowout preventer (BOP) system 100 can have a ram cylinder pressure housing 21 secured to the ram housing 5.

The ram cylinder pressure housing 21 can fluidly engage either or both of a hydraulic pressure source 101 or a pneumatic pressure source 102.

On one end of the ram cylinder pressure housing 21 can be a pressure containing end cap 24. The pressure containing end cap 24 can be mounted enabling easy access, maintenance and repair of the system.

An access flange 20 can be secured to the ram housing 5 enabling easy access, maintenance and repair of the system. Studded flanges 18*a*-18*h* can secure the pressure containing end cap 24 and studded flanges 18*i*-18*p* can secure the access flange 20. Gaskets 19*a* and 19*b* can be used with the pressure containing cap and access flange respectively. Additional gaskets can be used on the top and bottom of blowout protector housing 12 for bolting in and sealing to the wellhead, riser and/or lower marine riser package.

The angle-cut shear ram blowout preventer (BOP) system 100 can include at least one clamp 26*a* and 26*b* for engaging above and below the blowout protector housing 12 connecting, locking and sealing the angle-cut shear ram blowout preventer (BOP) system 100 to the blowout protector housing 12.

FIG. 2 depicts a cross section of the angle-cut shear ram blowout preventer (BOP) system.

The angle-cut shear ram blowout preventer (BOP) system 100 is shown with the ram cylinder pressure housing 21 with a piston 22, a moveable rod 23, and an angle-cut shear ram 14 in the retracted position. The angle-cut shear ram blowout preventer (BOP) system can include a pressure divider 25 with a seal and bearing assembly for the moveable rod 23.

The piston 22 can be aligned with the ram housing bore 6.

The hydraulic pressure source or the pneumatic pressure source can be fluidly connected to and power the piston 22 in the ram cylinder pressure housing. The psi can be very low to power the piston 22 however the psi must be enough to shear the heavy wall drill pipe. The psi used could be affected by the wall thickness of the heavy wall drill pipe, whether or not the heavy wall drill pipe is heat treated, such as a psi from 500 psi to 10,000 psi.

The moveable rod 23 can be connected to the piston 22. The moveable rod 23 can be moveable from a retracted position at least partially within the ram cylinder pressure housing 21 into the ram housing bore 6 of the ram housing 5.

The ram housing bore 6 can be secured to the blowout protector housing and intersects with the through bore 13, such as at a 90 degree angle. A center axis 104 for the ram housing bore 6 is also depicted.

The angle-cut shear ram blowout preventer (BOP) system 100 can fluidly communicate with the through bore 13.

The ram housing 5 can have the angle-cut shear ram 14, which can be connected to the moveable rod 23. The angle-cut shear ram 14 can have two portions, namely a body 15 engaging the moveable rod 23 and a taper 29 formed on the body 15 opposite the moveable rod 23.

The angle-cut shear ram 14 can be adapted to extend the taper 29 from the ram housing bore 6 into the through bore 13 to sever the heavy wall drill pipe as pressure is applied to the piston 22 from the pneumatic pressure source or the hydraulic pressure source. As the pressure extends at least a portion of the body 15 into the through bore 13, the body 15 of the angle-cut shear ram 14 creates a through bore seal in the through bore 13 after the heavy wall drill pipe is severed.

In embodiments, as the angle-cut shear ram 14 severs the heavy wall drill pipe and then extends the taper 29 from the ram housing bore 6 as pressure is applied, causing each length of stroke of the piston 22 to increase in length by a distance from 1 percent to 300 percent of a diameter of the through bore 13.

Hardened shear reaction inserts 16*a* and 16*b* can be mounted in relief recesses to engage the heavy wall drill pipe. It should be understood that as the angle-cut shear ram 14 applies load to the heavy wall drill pipe, the taper 29 also applies a lifting force to the heavy wall drill pipe at a 90 degree angle to the load from the angle-cut shear ram 14 while the hardened shear reaction inserts 16*a* and 16*b* hold the heavy wall drill pipe down.

Figure 3:
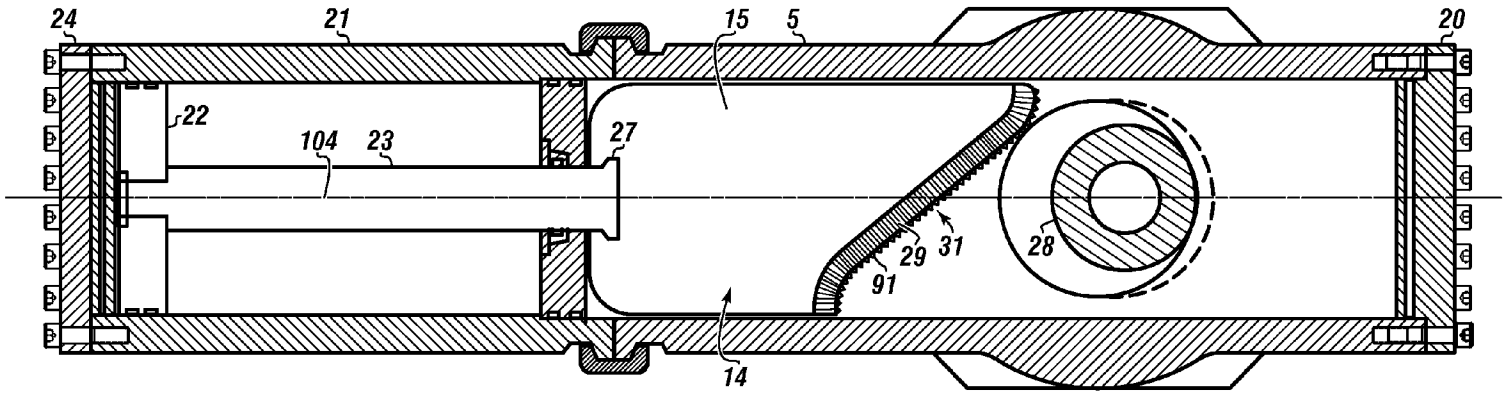
FIG. 3 depicts a view of the angle-cut shear ram prior to engagement with a pipe in the angle-cut shear ram blowout preventer (BOP) system.

FIG. 3 depicts a view of the angle-cut shear ram prior to engagement with a pipe in the angle-cut shear ram blowout preventer (BOP) system.

The ram housing 5 is shown connected to the ram cylinder pressure housing 21. The ram cylinder pressure housing 21 can contain the piston 22 and the angle-cut shear ram 14 in the retracted position. A cutting edge 31 of the angle-cut shear ram 14 can be at an angle on the taper 29, such as at a forty degree angle. A heavy wall drill pipe 28 is shown in the through bore.

The moveable rod 23 of the piston 22 extends and retracts along a center axis 104 of the angle-cut shear ram 14.

The angle-cut shear ram blowout preventer (BOP) system can have a tang 27 connecting the moveable rod 23 to the body 15. The angle-cut shear ram blowout preventer (BOP) system can have hardened serrated teeth 91 disposed on the cutting edge 31. The hardened serrated teeth 91 simultaneously (i) create a stress score mark while (ii) applying a lifting force for parting heavy wall drill pipe without deforming the hardened serrated teeth 91. The lifting force can range from 1,000 psi to 500,000 psi. The lifting force in embodiments can raise the heavy wall drill pipe 28 from 0.125 of an inch to 3 inches.

The access flange 20 is depicted secured to the ram housing 5, and the pressure containing end cap 24 is shown mounted to the ram cylinder pressure housing 21 enabling easy access, maintenance and repair of the angle-cut shear ream blowout preventer (BOP) system.

In embodiments, as the cutting edge 31 contacts the heavy wall drill pipe 28 at 40 degrees from the center axis 104 in the horizontal plane and angles back at 40 degrees or less from the center axis 104 in the vertical plane, the cutting edge of the taper 29 saws across the heavy wall drill pipe 28 at 40 degrees or less while simultaneously lifting the heavy wall drill pipe 28 at 40 degrees or more.

Figure 4:
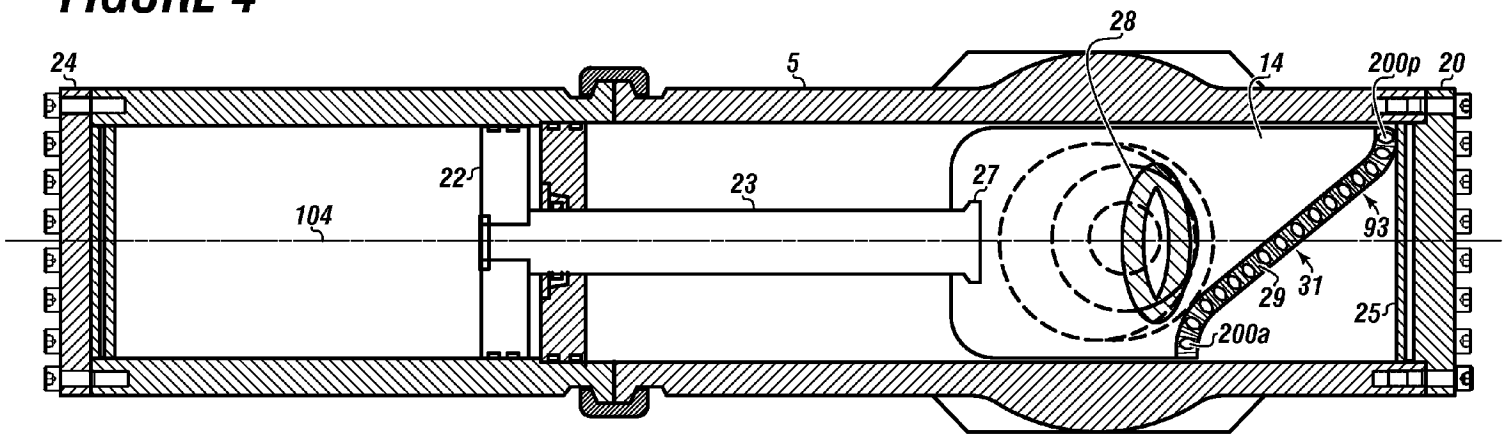
FIG. 4 depicts a view of the angle-cut shear ram fully extending creating a seal in the through bore.

FIG. 4 depicts a view of the angle-cut shear ram fully extending creating a seal in the through bore.

This Figure depicts the piston 22 and the angle-cut shear ram 14 in an extended position along the center axis 104, and wherein the heavy wall drill pipe 28 in the through bore is in a parted configuration, that is, the heavy wall drill pipe 28 can be successfully severed by the angle-cut shear ram 14.

The ram housing 5 containing moveable rod 23 of the piston 22 connected to the angle-cut shear ram 14 by tang 27 similar to the way a gate valve, which can be connected to a valve stem are depicted.

The pressure divider 25 can be mounted between the through bore and the ram housing 5. In embodiments, the pressure divider 25 can be mounted inside the ram cylinder pressure housing without fasteners.

Multiple high strength carbide cutting nodes 200*a*-200*p* can be installed on the cutting edge 31 of the taper 29. The multiple high strength carbide cutting nodes 200*a*-200*p* are depicted disposed on the taper 29. In embodiment, a tungsten carbide hardened edge 93 can be disposed on the taper 29.

The multiple high strength carbide cutting nodes 200*a*-200*p* can be of at least one of: a tungsten carbide insert, a synthetic diamond cutting material, a diamond enhanced cutting material, a diamond impregnated metal matrix, and combinations thereof.

In embodiments, if a diamond enhanced cutter material is used, the inserts can be at least two rows of diamond cutter material on the cutting edge 31.

The multiple high strength carbide cutting nodes 200*a*-200*p* can be flat faced, dome shaped, or combinations thereof. The poly-diamond cutter material and the multiple high strength carbide cutting nodes 200*a*-200*p* can have various shapes such as circular, elliptical, angular, or combinations thereof.

In embodiments, the tungsten carbide hardened edge 93 can be disposed on the cutting edge 31. In embodiments, the tungsten carbide hardened edge 93 can be a crushed tungsten carbide in a nickel bronze matrix. In embodiments, the tungsten carbide hardened edge 93 can be a plurality of separated tungsten carbide cutting segments formed in polygonal shapes.

The cutting materials, such as poly-diamond cutter nodes, can be grouped in circles, organized in swirl patterns, or in another pattern.

In embodiments, the density of the poly-diamond cutter nodes can range from about 0.125 of an inch to about 2 per inch. In an embodiment the poly-diamond cutter nodes can be aligned in rows of two poly-diamond cutter nodes to sixteen poly-diamond cutter nodes. In other embodiments, the poly-diamond cutter nodes can be aligned in rows, such as several nodes in rows of three.

In an embodiment, the poly-diamond cutter nodes can be made from synthetic diamond material made by US Synthetic of Orem, Utah. The poly-diamond cutter nodes can be flat faced, dome shaped, or combinations thereof. The poly-diamond cutter nodes can have a shape that is elliptical, circular, angular, or combinations thereof. The height of each poly-diamond cutter node as measured from the surface of one of the spiraled angled sections can range from flush flat to about ¾ of an inch.

The multiple high strength carbide cutting nodes 200*a*-200*p* can be formed on the spiral angled section, either as a single row, double rows, triple rows, multiple rows, or in patches. The multiple high strength carbide cutting nodes 200*a*-200*p* are known as "carbide inserts" in the industry. Usable high strength carbide cutting nodes can be round, elliptical, or angular. Usable high strength carbide cutting nodes can be flat faced or round faced.

The access flange 20 is depicted secured to the ram housing 5, and the pressure containing end cap 24 is depicted mounted to the ram cylinder pressure housing enabling easy access, maintenance and repair of the angle-cut shear ram blowout preventer (BOP) system.

In embodiments, the cutting edge 31 of the angle-cut shear ram 14 can travel at a 90 degree angle across the through bore engaging the heavy wall drill pipe 28 at an angle offset from a center axis 104 of the angle-cut shear ram 14.

In other embodiments, the angle-cut shear ram 14 can travel at a 90 degree angle across the through bore engaging the heavy wall drill pipe at an angle offset from 2 degrees to 40 degrees from the center axis 104 of the angle-cut shear ram 14.

FIG. 5 depicts a cross section of the angle-cut shear ram creating a stress score mark on the heavy wall drill pipe.

In embodiments, a section of the heavy wall drill pipe 28 can be a drill collar. The heavy wall drill pipe 28 can be in the through bore 13 of the blowout protector housing. The piston 22 with the moveable rod 23 in the ram cylinder pressure housing 21 can drive the angle-cut shear ram 14 into the heavy wall drill pipe 28 against the side of the through bore 13 and against the hardened shear reaction inserts 16*a* and 16*b* located in relief recesses 17*a* and 17*b*.

As the angle-cut shear ram 14 applies load to the heavy wall drill pipe 28, the taper 29 also applies a lifting force to the heavy wall drill pipe 28 at a 90 degree angle to the load from the angle-cut shear ram 14 while the hardened shear reaction inserts 16*a* and 16*b* hold the heavy wall drill pipe 28 down. This pulling apart action plus the sawing action of the cutting edge of angle-cut shear ram 14 causes the heavy wall drill pipe 28 to part.

The hardened shear reaction inserts 16*a* and 16*b* grip and hold one side of the heavy wall drill pipe 28 while the other side of the heavy wall drill pipe 28 is being cut and lifted by the taper 29.

A stress score mark 59 can be formed circumferentially on the heavy wall drill pipe by the cutting edge as pressure is applied to the piston 22.

Figure 6:
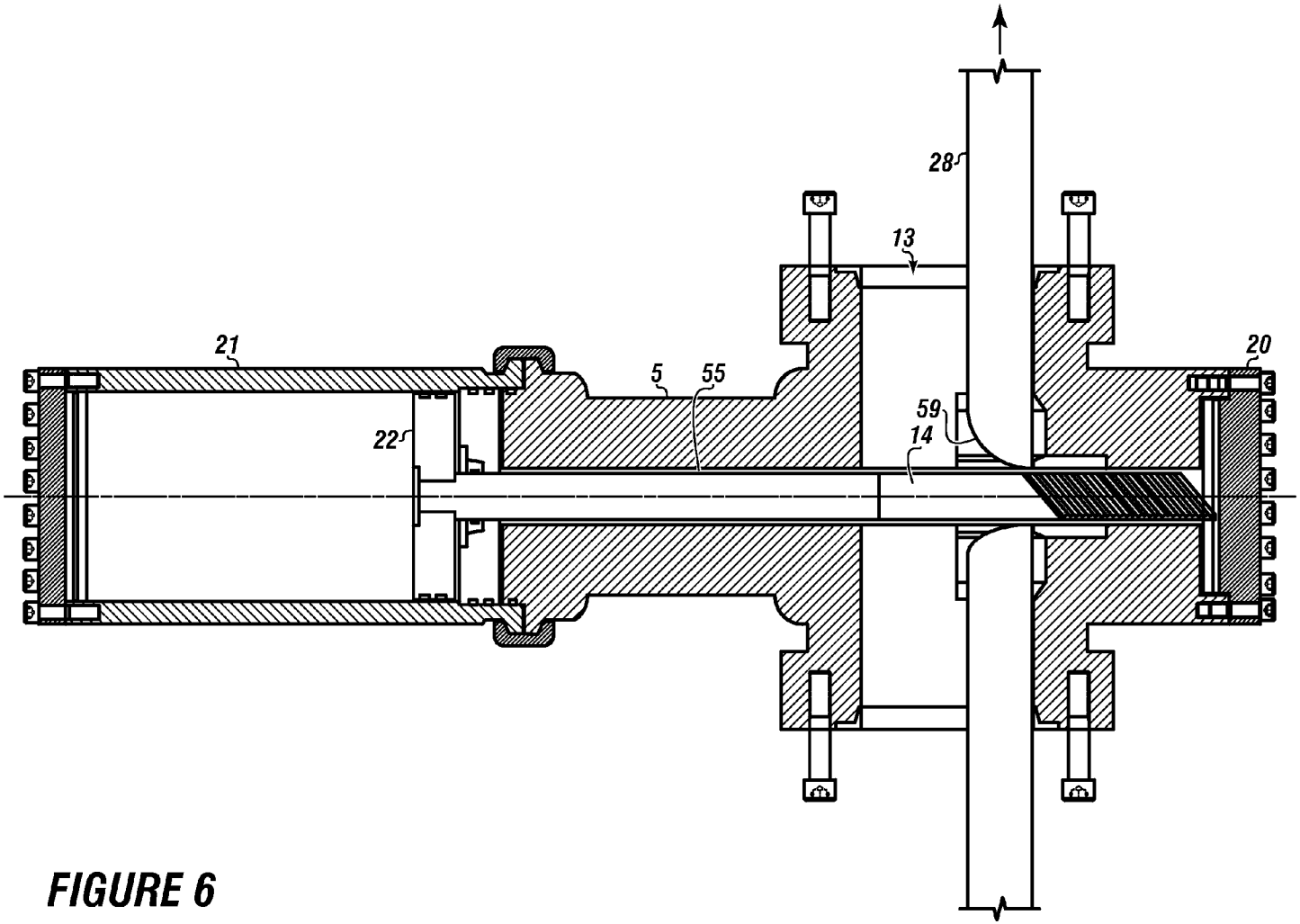
FIG. 6 depicts a view of the angle-cut shear ram after cutting and lifting the heavy wall drill pipe in the through bore.

FIG. 6 depicts a view of the angle-cut shear ram after cutting and lifting the heavy wall drill pipe in the through bore.

The ram cylinder pressure housing 21 with the piston 22 is shown pushing against the angle-cut shear ram 14 in the ram housing 5.

The angle-cut shear ram 14 is shown fully engaged across the through bore 13 of blowout protector housing and connecting against the access flange 20 with the heavy wall drill pipe 28 fully parted.

The upper part of the heavy wall drill pipe 28 has lifted and can be resting on top of the angle-cut shear ram 14 and the angle-cut shear ram 14 can form a metal seal across the through bore 13 of the blowout protector housing.

In embodiments as the angle-cut shear ram blowout preventer (BOP) system can move the angle-cut shear ram 14 from a retracted position in the ram housing bore into the through bore 13, the angle-cut shear ram 14 can exert a load on the heavy wall drill pipe 28 in the through bore 13 rotating the heavy wall drill pipe 28 in the through bore 13 while simultaneously applying: (i) a circumferential sawing action on the heavy wall drill pipe creating the stress score mark 59 on the heavy wall drill pipe 28 while the heavy wall drill pipe 28 rotates in the through bore 13. The angle-cut shear ram 14 simultaneously with the circumferential sawing action applies (ii) a lifting force at the formed stress score mark 59 causing the heavy wall drill pipe 28 to separate.

In embodiments, the angle-cut shear ram blowout preventer (BOP) system can have a sliding ram track 55 mounted in the ram housing bore engaging the taper as the taper moves from a retracted location in the ram housing bore into the through bore. In embodiments, two rails can be used in parallel to align the angle-cut shear ram. In other embodiments, the sliding ram track 55 can be integral in the ram housing bore.

Figure 7:
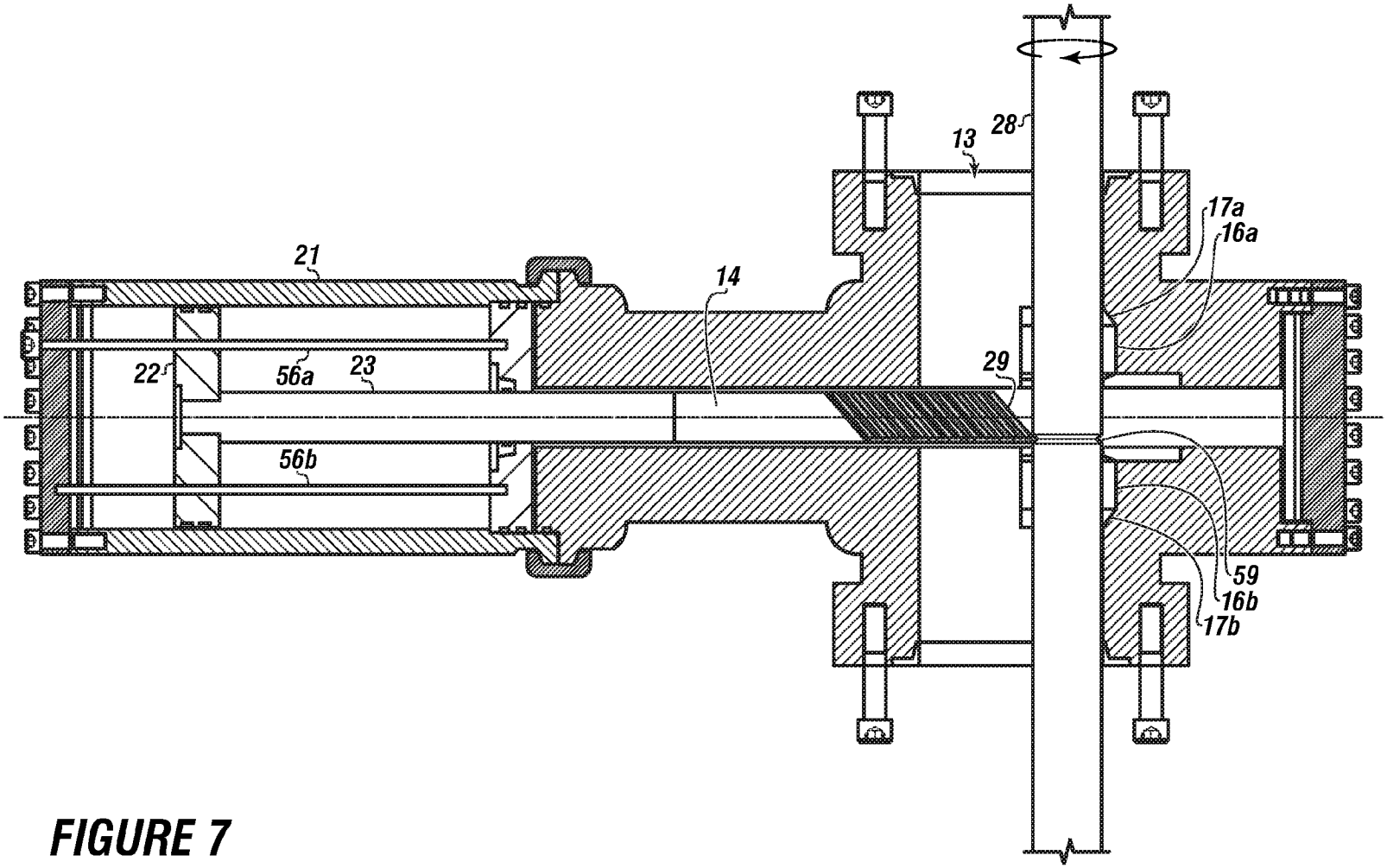
FIG. 7 depicts a view of the angle-cut shear ram with rails.

FIG. 7 depicts a view of the angle-cut shear ram as shown in FIG. 5 with rails.

The angle-cut shear ram 14 is shown with rails 56*a* and 56*b*, which can be positioned in a substantially parallel manner and serve to prevent the piston 22 from rotating or becoming cocked within the ram cylinder pressure housing 21. As shown, the rails can be completely internal as shown by rail 56*a*, or enter the ram cylinder pressure housing from the outside, as shown by rail 56*b*. Persons having ordinary skill in the art can decide on the appropriate design based upon a specific application.

While these embodiments have been described with emphasis on the embodiments, it should be understood that within the scope of the appended claims, the embodiments might be practiced other than as specifically described herein.

What is claimed is:

1. An angle-cut shear ram blowout preventer (BOP) system to be used over a well when drilling for hydrocarbons through subterranean geological formations, during a blowout, the angle-cut shear ram blowout preventer (BOP) system is configured to simultaneously sever a heavy wall drill pipe in the well and seal the well once the heavy wall drill pipe is severed without requiring additional downhole tools, the angle-cut shear ram blowout preventer (BOP) system is installed on a blowout protector housing having a through bore, the through bore containing the heavy wall drill pipe, the heavy wall drill pipe extending between the well and a surface, the angle-cut shear ram blowout preventer (BOP) system comprising:

a. a ram housing with a ram housing bore, wherein the ram housing is secured to the blowout protector housing, and wherein the ram housing bore intersects with the through bore;

b. a ram cylinder pressure housing secured to the ram housing, wherein the ram cylinder pressure housing is fluidly connected to a hydraulic pressure source or a pneumatic pressure source;

c. a piston in the ram cylinder pressure housing, wherein the piston is aligned with the ram housing bore, wherein the piston is fluidly connected to the hydraulic pressure source or the pneumatic pressure source;

d. a moveable rod connected to the piston, at least partially within the ram cylinder pressure housing, moveable from a retracted position to an extended position in the ram housing bore; and e. an angle-cut shear ram connected to the moveable rod, wherein the angle-cut shear ram comprises:

(i) a body engaging the moveable rod; and (ii) a taper with a cutting edge formed on the body opposite the moveable rod; and wherein the angle-cut shear ram is adapted to extend the taper from the ram housing bore into the through bore to sever the heavy wall drill pipe as pressure is applied to the piston from the hydraulic pressure source or the pneumatic pressure source, and extend at least a portion of the body into the through bore creating a through bore seal in the through bore with at least a portion of the body after the heavy wall drill pipe is severed by the taper; and wherein the angle-cut shear ram is configured to move from a retracted position in the ram housing bore through the through bore exerting a load on the heavy wall drill pipe in the through bore rotating the heavy wall drill pipe in the through bore while simultaneously applying: a circumferential sawing action on the heavy wall drill pipe creating a stress score mark on the heavy wall drill pipe while the heavy wall drill pipe rotates in the through bore and a lifting force at the formed stress score mark causing the heavy wall drill pipe to separate.

2. The angle-cut shear ram blowout preventer (BOP) system of claim 1, further comprising hardened serrated teeth disposed on the cutting edge, wherein the hardened serrated teeth simultaneously create the stress score mark and apply the lifting force for parting the heavy wall drill pipe without deforming.

3. The angle-cut shear ram blowout preventer (BOP) system of claim 2, wherein the cutting edge of the angle-cut shear ram travels at a 90 degree angle across the through bore engaging the heavy wall drill pipe at an angle offset from a center axis of the angle-cut shear ram.

4. The angle-cut shear ram blowout preventer (BOP) system of claim 3, wherein the angle-cut shear ram travels at a 90 degree angle across the through bore engaging the heavy wall drill pipe at an angle offset, from 2 degrees to 40 degrees, from the center axis of the angle-cut shear ram.

5. The angle-cut shear ram blowout preventer (BOP) system of claim 3, wherein as the cutting edge engages the heavy wall drill pipe at 40 degrees from the center axis in a horizontal plane and angles back at 40 degrees or less from the center axis in a vertical plane, the cutting edge of the taper saws across the heavy wall drill pipe at 40 degrees or less while simultaneously lifting the heavy wall drill pipe at 40 degrees or more.

6. The angle-cut shear ram blowout preventer (BOP) system of claim 3, wherein as the angle-cut shear ram severs the heavy wall drill pipe and then extends the taper from the ram housing bore as pressure is applied, causing each length of stroke of the piston to increase in length by a distance from 1 percent to 300 percent of a diameter of the through bore.

7. The angle-cut shear ram blowout preventer (BOP) system of claim 5, further comprising a plurality of hardened reaction inserts to grip and hold one side of the heavy wall drill pipe while an opposite side of the heavy wall drill pipe is being cut and lifted by the taper.

8. The angle-cut shear ram blowout preventer (BOP) system of claim 7, further comprising a clamp for engaging above and below the blowout protector housing connecting, locking and sealing the angle-cut shear ram blowout preventer (BOP) system to the blowout protector housing.

9. The angle-cut shear ram blowout preventer (BOP) system of claim 1, further comprising a tang for connecting the moveable rod to the body.

10. The angle-cut shear ram blowout preventer (BOP) system of claim 1, further comprising an access flange secured to the ram housing enabling easy access, maintenance, and repair of the angle-cut shear ram blowout preventer (BOP) system, and a pressure containing end cap mounted to the ram cylinder pressure housing enabling easy access, maintenance, and repair of the angle-cut shear ram blowout preventer (BOP) system.

11. The angle-cut shear ram blowout preventer (BOP) system of claim 1, further comprising a pressure divider mounted between the through bore and the ram housing.

12. The angle-cut shear ram blowout preventer (BOP) system of claim 11, wherein the pressure divider is mounted inside the ram cylinder pressure housing without fasteners.

13. The angle-cut shear ram blowout preventer (BOP) system of claim 1, further comprising a sliding ram track mounted in the ram housing bore engaging the taper as the taper moves from a retracted location in the ram housing bore into the through bore.

14. The angle-cut shear ram blowout preventer (BOP) system of claim 13, wherein the sliding ram track is integral in the ram housing bore.

15. The angle-cut shear ram blowout preventer (BOP) system of claim 1, further comprising multiple high strength carbide cutting nodes disposed on the taper.

16. The angle-cut shear ram blowout preventer (BOP) system of claim 15, wherein at least one of the multiple high strength carbide cutting nodes is comprised of at least one of: a tungsten carbide insert, a synthetic diamond cutting material, a diamond enhanced cutting material, a diamond impregnated metal matrixes, and combinations thereof.

17. The angle-cut shear ram blowout preventer (BOP) system of claim 1, further comprising a tungsten carbide hardened edge disposed on the taper.

18. The angle-cut shear ram blowout preventer (BOP) system of claim 1, further comprising two rails positioned substantially parallel to each other to align the angle-cut shear ram.

19. An angle-cut shear ram blowout preventer (BOP) system to be used over a well when drilling for hydrocarbons through subterranean geological formations, during a blowout, the angle-cut shear ram blowout preventer (BOP) system is configured to simultaneously sever a heavy wall drill pipe in the well and seal the well once the heavy wall drill pipe is severed without requiring additional downhole tools, the angle-cut shear ram blowout preventer (BOP) system is installed on a blowout protector housing having a through bore, the through bore containing the heavy wall drill pipe, the heavy wall drill pipe extending between the well and a surface, the angle-cut shear ram blowout preventer (BOP) system comprising:

a. a ram housing with a ram housing bore, wherein the ram housing is secured to the blowout protector housing, and wherein the ram housing bore intersects with the through bore;

b. a ram cylinder pressure housing secured to the ram housing, wherein the ram cylinder pressure housing is fluidly connected to a hydraulic pressure source or a pneumatic pressure source;

c. a piston in the ram cylinder pressure housing, wherein the piston is aligned with the ram housing bore, wherein the piston is fluidly connected to the hydraulic pressure source or the pneumatic pressure source;

d. a moveable rod connected to the piston, at least partially within the ram cylinder pressure housing, moveable from a retracted position to an extended position in the ram housing bore;

e. an angle-cut shear ram connected to the moveable rod, wherein the angle-cut shear ram comprises:

(i) a body engaging the moveable rod; and (ii) a taper with a cutting edge formed on the body opposite the moveable rod; and f. an access flange secured to the ram housing enabling easy access, maintenance, and repair of the angle-cut shear ram blowout preventer (BOP) system, and a pressure containing end cap mounted to the ram cylinder pressure housing enabling easy access, maintenance, and repair of the angle-cut shear ram blowout preventer (BOP) system.

20. An angle-cut shear ram blowout preventer (BOP) system to be used over a well when drilling for hydrocarbons through subterranean geological formations, during a blowout, the angle-cut shear ram blowout preventer (BOP) system is configured to simultaneously sever a heavy wall drill pipe in the well and seal the well once the heavy wall drill pipe is severed without requiring additional downhole tools, the angle-cut shear ram blowout preventer (BOP) system is installed on a blowout protector housing having a through bore, the through bore containing the heavy wall drill pipe, the heavy wall drill pipe extending between the well and a surface, the angle-cut shear ram blowout preventer (BOP) system comprising:

a. a ram housing with a ram housing bore, wherein the ram housing is secured to the blowout protector housing, and wherein the ram housing bore intersects with the through bore;

b. a ram cylinder pressure housing secured to the ram housing, wherein the ram cylinder pressure housing is fluidly connected to a hydraulic pressure source or a pneumatic pressure source;

c. a piston in the ram cylinder pressure housing, wherein the piston is aligned with the ram housing bore, wherein the piston is fluidly connected to the hydraulic pressure source or the pneumatic pressure source;

d. a moveable rod connected to the piston, at least partially within the ram cylinder pressure housing, moveable from a retracted position to an extended position in the ram housing bore;

e. an angle-cut shear ram connected to the moveable rod, wherein the angle-cut shear ram comprises:

(i) a body engaging the moveable rod; and (ii) a taper with a cutting edge formed on the body opposite the moveable rod; and f. a sliding ram track mounted in the ram housing bore engaging the taper as the taper moves from a retracted location in the ram housing bore into the through bore.

* * * * *